US007437116B2

(12) United States Patent
Lee

(10) Patent No.: US 7,437,116 B2
(45) Date of Patent: Oct. 14, 2008

(54) DEVELOPING APPARATUS AND IMAGE FORMING APPARATUS USING THE SAME

(75) Inventor: Min-soo Lee, Uiwang-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 108 days.

(21) Appl. No.: 11/158,089

(22) Filed: Jun. 22, 2005

(65) Prior Publication Data

US 2005/0286941 A1 Dec. 29, 2005

(30) Foreign Application Priority Data

Jun. 23, 2004 (KR) ..... 10-2004-0046951

(51) Int. Cl.
*G03G 21/00* (2006.01)

(52) U.S. Cl. ..... 399/359; 399/360

(58) Field of Classification Search ..... 399/359, 399/360

See application file for complete search history.

(56) References Cited

U.S. PATENT DOCUMENTS

| | | | | |
|---|---|---|---|---|
| 6,085,062 | A * | 7/2000 | Mizuishi et al. | 399/358 |
| 6,366,755 | B1 * | 4/2002 | Takashima | 399/254 |
| 2002/0051664 | A1 * | 5/2002 | Aoki et al. | 399/359 |

FOREIGN PATENT DOCUMENTS

| | | |
|---|---|---|
| JP | 09-166912 | 6/1997 |
| JP | 11-084968 | 3/1999 |
| KR | 10-2002-0016388 | 3/2002 |
| KR | 1020040002096 A | 1/2004 |
| KR | 10-2004-0020745 | 3/2004 |

* cited by examiner

*Primary Examiner*—David M. Gray
*Assistant Examiner*—David A Blackshire
(74) *Attorney, Agent, or Firm*—Roylance, Abrams, Berdo & Goodman, L.L.P.

(57) ABSTRACT

A developing apparatus includes a toner collection apparatus having a waste toner accommodation chamber that temporarily accommodates waste toner removed from a photosensitive medium. A screw to transfer the waste toner is installed in the chamber. A collection path connects the waste toner accommodation chamber to a developing chamber that holds new toner to be supplied to the photosensitive medium. Waste toner is delivered through the collection path to the developing chamber. An agitator that agitates the waste toner to prevent the collection path from being clogged is provided. The agitator includes a pivoting body installed in the collection path. One end of the pivoting body selectively contacts the screw. The other end of the pivoting body is connected to an agitating body that is arranged in a lengthwise direction of the collection path. As the screw rotates, the pivoting body pivots, thereby moving the agitating body so that it agitates waste toner in the collection path.

28 Claims, 5 Drawing Sheets

DEVELOPING APPARATUS AND IMAGE FORMING APPARATUS USING THE SAME

CROSS-REFERENCE TO RELATED APPLICATIONS

This application claims the benefit under 35 U.S.C. § 119 (a) of Korean Patent Application No. 10-2004-0046951, filed on Jun. 23, 2004, the entire disclosure of which is hereby incorporated by reference.

BACKGROUND OF THE INVENTION

1. Field of the Invention

The present invention relates to an image forming apparatus. More particularly, the present invention relates to an image forming apparatus having an agitator that prevents a collection path from being clogged by toner.

2. Description of the Related Art

In general, an image forming apparatus forms a desired image by receiving a digital image signal, forming an electrostatic latent image on a photosensitive medium using an exposing apparatus such as a laser scanning unit, developing the electrostatic latent image into a toner image using toner, transferring the toner image to a print medium, and fusing the toner image on the print medium by applying heat and pressure.

Image forming apparatuses can be generally classified as either dry type or wet type depending on the type of toner and carrier used. Dry type image forming apparatuses can be further classified as either mono-component systems or dual-component systems. A mono-component system forms an image by supplying toner alone. A dual-component system forms an image by supplying a carrier on which toner particles adhere.

In a mono-component system, after the toner image on the photosensitive medium is transferred to the print medium, any excess toner remaining on the surface of the photosensitive medium is removed by a cleaning blade and collected by a collection apparatus for reuse. In a dual-component system, the carrier is not supplied to the photosensitive medium. Instead, the carrier is collected while the toner particles are supplied to the photosensitive medium to develop a toner image. Thus, like in a mono-component system, any excess toner particles remaining on the surface of the photosensitive medium are removed by a cleaning blade and collected by a collection apparatus for reuse. It should be noted that these descriptions relate to forming a black and white image. When a color image is formed, it is difficult to reuse any collected toner because the various color toners are mixed together in the toner image remaining on the surface of the photosensitive medium.

Toner is a light powder, and during the process of collecting the toner removed by the cleaning blade, the toner transfer path can become clogged by hardened toner. When the toner transfer path is clogged, the collected toner is not supplied to a developing chamber. Instead, it leaks out of the developing apparatus, or it increases the rotational torque of a toner transfer apparatus, causing damage to the toner transfer apparatus.

Thus, due to the toner clogging, the developer needs to be replaced, even though the remainder of the developer still has a useful life span. This increases costs. To prevent the necessity of replacing the entire developer, a separate transfer apparatus to transfer toner along the toner transfer path is provided. The separate transfer apparatus smoothly collects toner without accumulating toner on the toner transfer path.

Since the transfer apparatus needs to be installed separately, however, the cost of the system increases.

Accordingly, there is a need for an image forming apparatus with an improved system for collecting and reusing toner.

SUMMARY OF THE INVENTION

An aspect of the present invention is to solve at least the above problems and/or disadvantages and to provide at least the advantages described below. Accordingly, an aspect of the present invention is to provide an image forming apparatus which prevents toner which is removed from the photosensitive medium and collected for reuse from accumulating and hardening on the collection path.

According to an aspect of the present invention, a developing apparatus is provided including a toner collection apparatus having a waste toner accommodation chamber that temporarily accommodates waste toner removed from a photosensitive medium. A screw to transfer the waste toner is installed in the accommodation chamber. A collection path connects the waste toner accommodation chamber to a developing chamber so that waste toner can be delivered to the developing chamber. The developing chamber accommodates new toner that is supplied to the photosensitive medium. The collection path has an agitator for agitating waste toner and thereby preventing the collection path from being clogged. The agitator comprises a pivoting body rotatably installed in the collection path. One end of the pivoting body connects to the screw, and the other end connects to an agitating body. The agitating body is arranged lengthwise in the collection path and agitates waste toner by interacting with the pivoting of the pivoting body.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENT

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
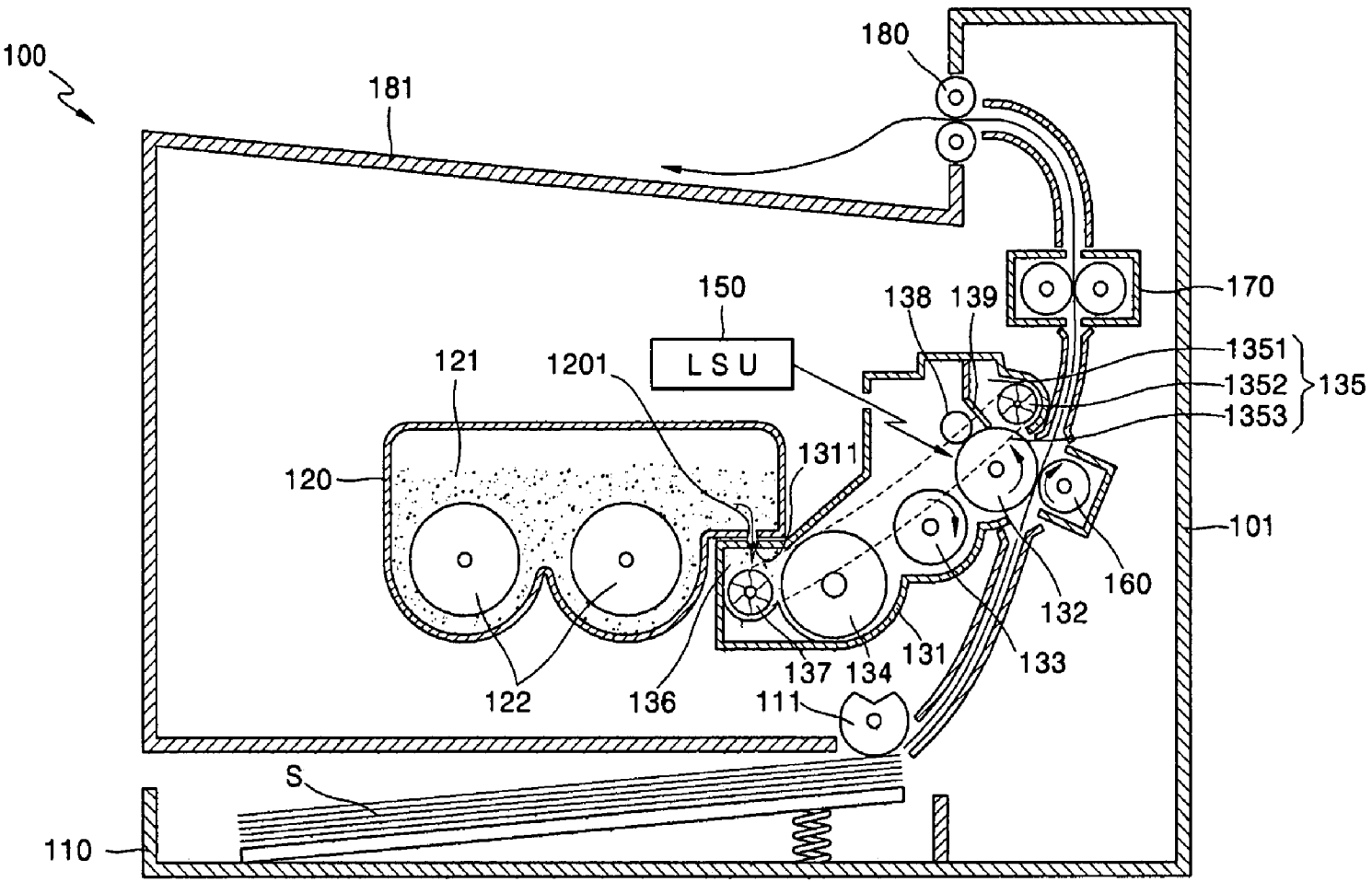
FIG. 1 is a side sectional view of an image forming apparatus with a developing apparatus having an agitator according to an embodiment of the present invention.

Referring to FIG. 1, an image forming apparatus 100 includes a paper cassette 110, a toner reservoir 120, a developing apparatus 130, an exposing unit 150, a transfer roller 160, a fusing apparatus 170, and a paper ejection roller 180.

The paper cassette 110 contains paper S and is detachably installed on a main body 101. A pickup roller 111 is rotatably installed in the main body 101 above the paper cassette 110. The pickup roller 111 picks individual sheets of paper S from the paper cassette 110. The toner reservoir 120 is detachably installed on the main body 101 and stores toner 121. An agitating roller 122 to agitate the toner 121 to prevent it from hardening is installed in the toner reservoir 120. When the toner 121 is depleted, the toner reservoir 120 can be replaced.

The developing apparatus 130 is detachably installed on the main body 101. The developing apparatus develops an electrostatic latent image formed on a photosensitive drum 132 into a toner image. The developing apparatus 130 is encompassed by a housing 131 and includes the photosensitive drum 132, a magnet roller 133, a mixing roller 134, a charging roller 138, and a waste toner collection apparatus 135.

An inlet 1311 is provided at a portion of the housing 131 adjacent to the toner reservoir 120. The inlet 1311 is installed to connect an outlet 1201 provided at the toner reservoir 120 so that the toner 121 contained in the toner reservoir 120 enters a developing chamber 136.

The photosensitive drum 132 is installed such that part of it is exposed outside of the housing 131. An electrostatic latent image is formed on an outer circumferential surface of the photosensitive drum 132 by light radiated from the exposing unit 150.

The magnet roller 133 rotates close to the photosensitive drum 132. The magnet roller applies the toner 121 to the photosensitive drum 132 by using a repulsive force generated by a voltage differential.

The mixing roller 134 is rotatably installed in the developing chamber 136 and mixes new toner from the toner reservoir 120 (that enters through the inlet 1311) and waste toner collected from the photosensitive drum 132. A transfer screw 137 is installed in the developing chamber 136. The transfer screw 137 rotates close to the mixing roller 134 and circulates the waste toner collected from the photosensitive drum 132 and the new toner from the developing chamber 136.

The waste toner collection apparatus 135 collects waste toner remaining on the photosensitive drum 132 (that is, toner that has not been transferred to the paper S) and includes a waste toner accommodation chamber 1351, a collection screw 1352, and a collection path 1353.

The waste toner accommodation chamber 1351 temporarily holds waste toner that has been removed from the photosensitive drum 132 by the cleaning blade 139 that is installed above the photosensitive drum 132.

Figure 3:
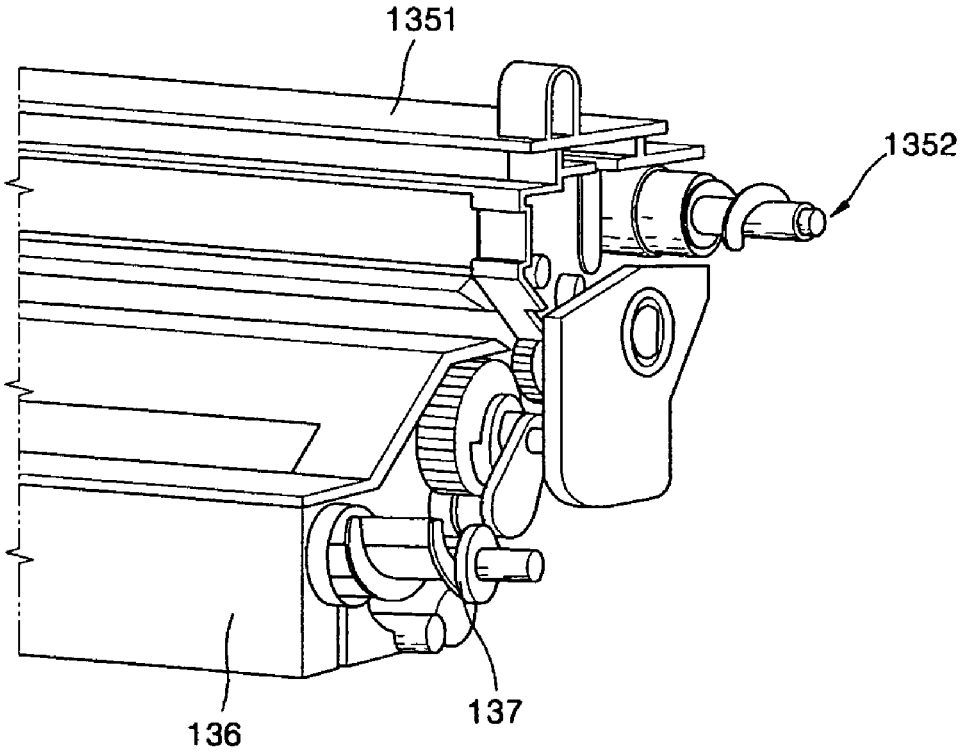
FIG. 3 is a perspective view of a part of the developing apparatus in which the collection path is removed.
Figure 4:
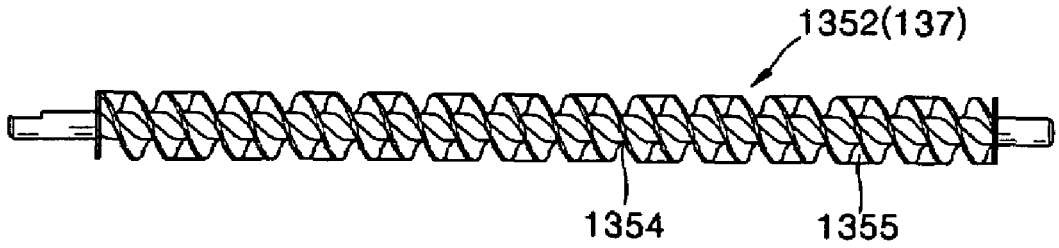
FIG. 4 is a view of the screw shown in FIG. 3.

The collection screw 1352 is rotatably installed in the waste toner accommodation chamber 1351 and transfers the waste toner held in the waste toner accommodation chamber 1351 toward the collection path 1353. As shown in FIGS. 3 and 4, the screw has a plurality of spiral flights 1354 and a plurality of transfer portions 1355 between the flights to smoothly transfer the waste toner. Thus, as the collection screw 1352 rotates, the waste toner is transferred by the transfer portions 1355 in a lengthwise direction of the collection screw 1352 towards the collection path 1353.

Figure 2:
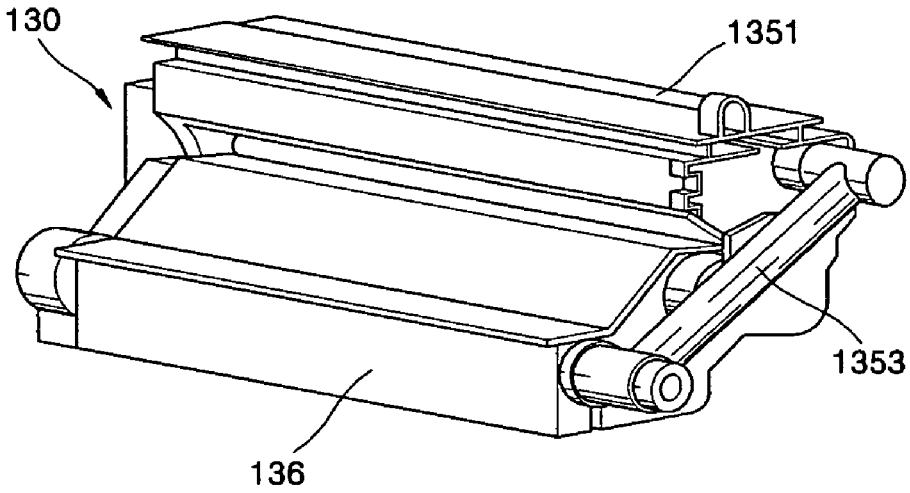
FIG. 2 is a perspective view of the developing apparatus of FIG. 1.

The collection path 1353 connects the waste toner accommodation chamber 1351 and the developing chamber 136 so that the waste toner is transferred to the developing chamber 136. The collection path 1353, as shown in FIGS. 1 and 2, is inclined from the waste toner accommodation chamber 1351 toward the developing chamber 136 so that the waste toner transferred by the collection screw 1352 slides down along the collection path 1353 toward the developing chamber 136.

The exposing unit 150 forms an electrostatic latent image by radiating light toward the photosensitive drum 132. The drum is charged to a predetermined electric potential, and the exposure to light drops the electric potential of the portion exposed by the light so that the remaining potential is less than a predetermined electric potential. A laser scanning unit is generally used as the exposing unit 150.

The transfer roller 160 faces and contacts the photosensitive drum 132 to press the paper S passing through a contact portion against the photosensitive drum 132 so that the toner image formed on the surface of the photosensitive drum 132 is transferred to the paper S.

The fusing apparatus 170 fuses the toner image onto the paper S. The fusing apparatus includes a heating roller that generates and applies heat to the toner image and a press roller that presses the toner image against the paper S.

The paper ejection apparatus 180 ejects the paper S on which the toner image is fused out of the main body 101. As a plurality of rollers rotate in contact with each other, the paper S is ejected out of the main body 101. The paper S is ejected onto a paper ejection tray 181.

Figure 5:
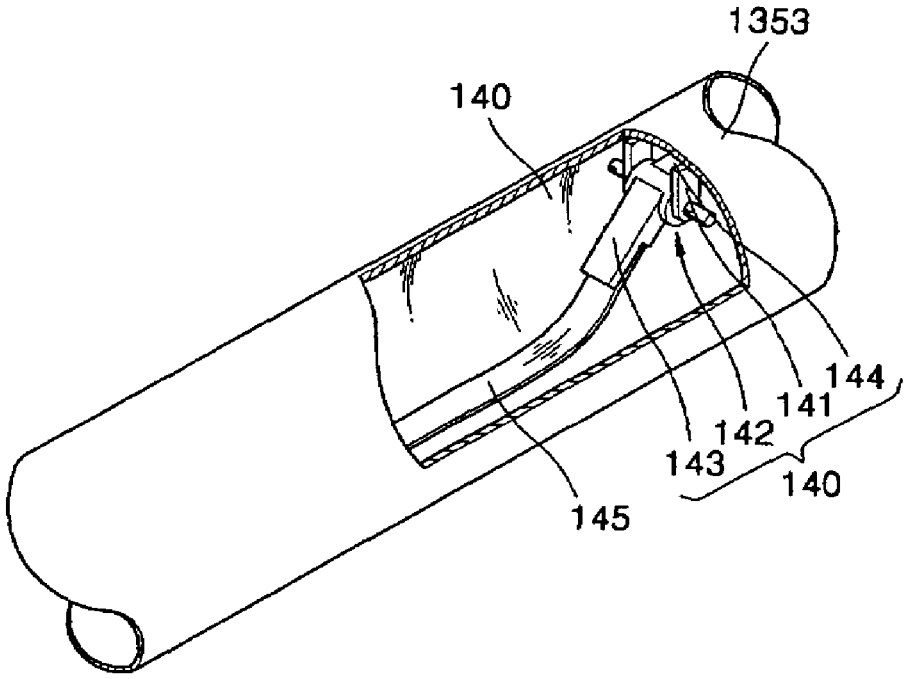
FIG. 5 is a partially cut-away perspective view of the agitator in the collection path.

FIG. 5 is a partially cut-away perspective view illustrating an agitator 140 in the collection path 1353. Referring to FIG. 5, the agitator 140 agitates waste toner in the collection path 1353 to prevent the collection path 1353 from being clogged by accumulated and hardened waste toner in the collection path 1353. The agitator 140 includes a pivoting body 142 and an agitating body 145.

Figure 6:
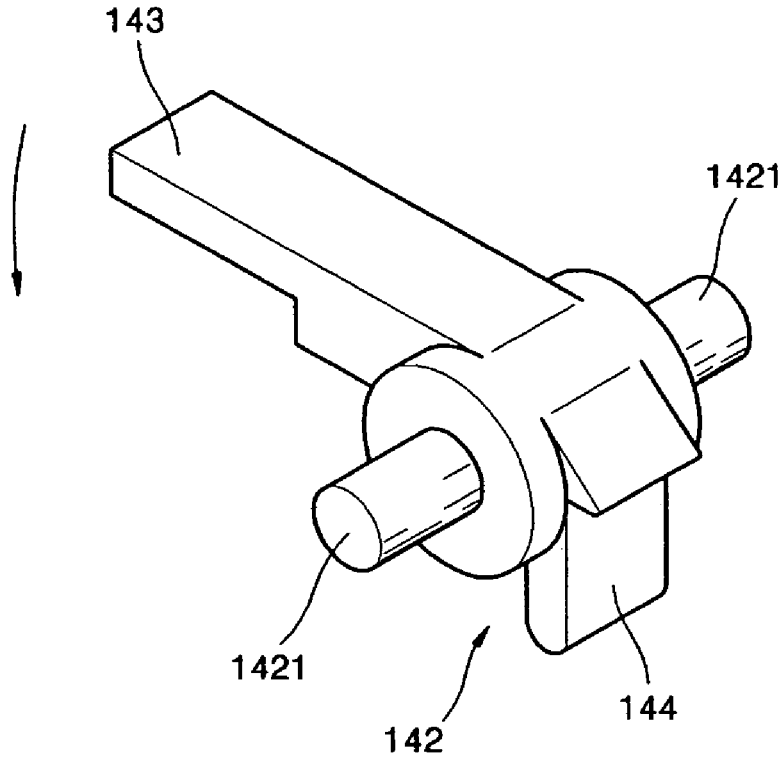
FIG. 6 is a perspective view of the pivoting body shown in FIG. 5.

The pivoting body 142 is rotatably supported by a pair of support portions 1421 provided in the upper portion of the collection path 1353. The pivoting body 142 has a contact portion 144 on one side for contacting the transfer portion 1355 of the waste toner transfer screw 1352. The pivoting body 142 has a connection portion 143 on the other side where the agitating body 145 is installed. Preferably, the length of the connection portion 143 is greater than that of the contact portion 144 50 that the weight of the connection portion 143 is greater than that of the contact portion 144. Thus, when no external force is applied to the pivoting body 142, the pivoting body 142 pivots toward the connection portion 143 due to gravity (in a direction indicated by an arrow shown in FIG. 6).

The agitating body 145 is arranged lengthwise in the collection path 1353. One end is fixed to the connection portion 143 and the other end is not fixed, that is, it is a free end. The agitating body 145 is a film of material having a predetermined thickness, width, and elasticity. Thus, as the pivoting body 142 pivots, the agitating body 145 moves by interacting with the pivoting body 142 and agitates the waste toner accumulated in the collection path 1353.

Figure 7:
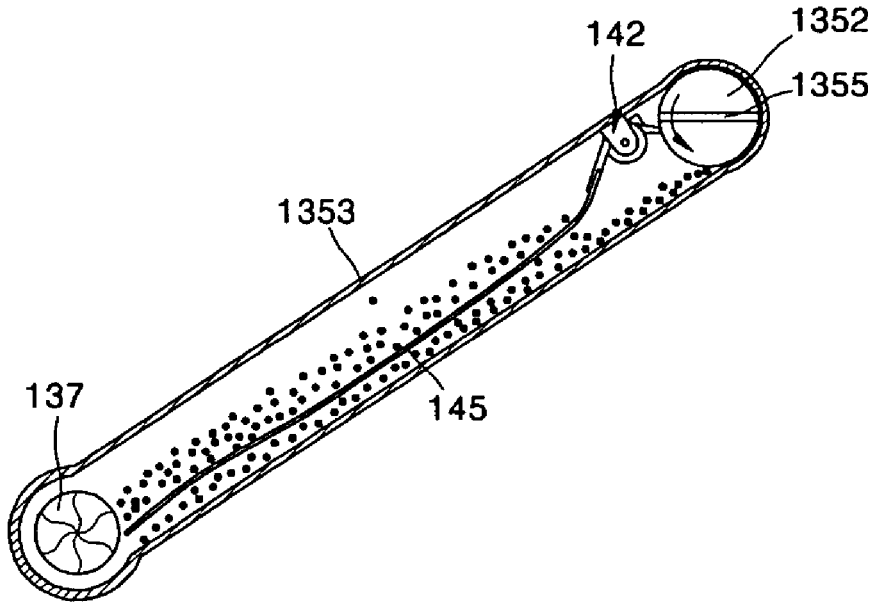
FIGS. 7 through 9 are views showing the operation of the agitator, in order.
Figure 8:
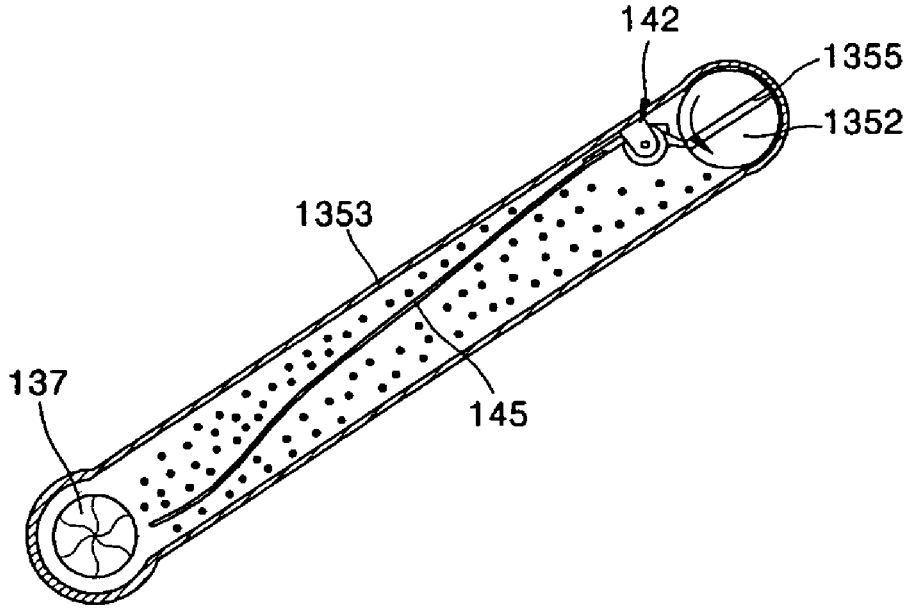
Figure 9:
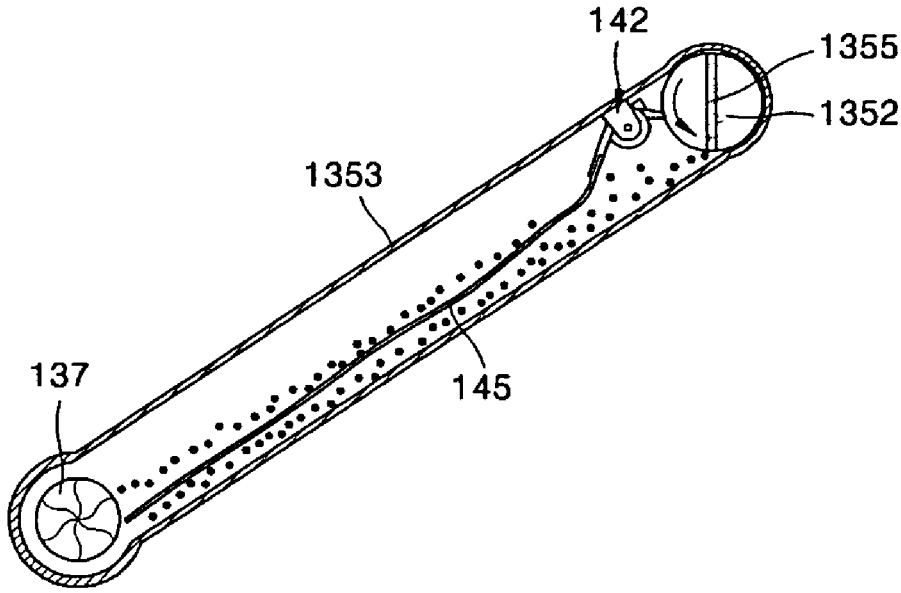

FIGS. 7-9 illustrate the operation of the embodiment of the present invention described above. As the collection screw 1352 rotates in the waste toner accommodation chamber 1351 in the direction indicated by an arrow, the transfer portion 1355 contacts the contact portion 144 of the pivoting body 142. The pivoting body 142 pivots in the opposite direction. The agitating body 145, which is fixedly connected to the connection portion 143, moves upward to agitate the waste toner accumulated in the collection path 1353.

As the collection screw 1352 continues to rotate, the transfer portion 1355 is separated from the contact portion 144.

When this happens, the pivoting body 142 pivots toward the connection portion 143 due to the weight of the connection portion 143 and returns to its original position.

The contact and separation repeats as the collection screw rotates. Thus, the agitating body 145 agitates the waste toner by moving up and down in the collection path 1355.

The period of the pivoting body 142 varies depending on the position and number of transfer portions 1355 attached to the collection screw 1352. When a large number of transfer portions are attached to the collection screw 1352, the number of transfer portions 1355 contacting the contact portion 144 increases so that the period of the pivoting body 142 is shortened.

In a developing apparatus according to the present invention, the waste toner in the collection path is agitated so that it does not accumulate. This prevents contamination of the inside of the developing apparatus due to leakage of waste toner, contamination of the print medium, and damage to the collection screw by an increase in the required rotational torque due to clogging of the collection path. It also increases the life span of the developing apparatus.

While the invention has been shown and described with reference to certain embodiments thereof, it will be understood by those skilled in the art that various changes in form and details may be made therein without departing from the spirit and scope of the invention as defined by the appended claims.

What is claimed is:

1. A developing apparatus including a toner collection apparatus having a waste toner accommodation chamber that temporarily accommodates waste toner removed from a photosensitive medium, a screw installed in the waste toner accommodation chamber for transferring waste toner, a developing chamber for accommodating new toner to be supplied to the photosensitive medium, a collection path that connects the waste toner accommodation chamber to the developing chamber and through which the waste toner is delivered to the developing chamber, and an agitator for agitating waste toner to prevent the collection path from being clogged, wherein the agitator comprises:

a pivoting body rotatably installed in the collection path and having one end in connection with the screw, the pivoting body being pivotally mounted to reciprocate about a fixed pivot point in the collection path between a first position and a second position by rotation of the screw; and an agitating body connected to the other end of the pivoting body and arranged lengthwise in the collection path for agitating waste toner by interacting with the pivoting of the pivoting body.

2. The developing apparatus according to claim 1, wherein the pivoting body comprises a contact portion intermittently contacting the screw to pivot the pivoting body between the first position and the second position and a connection portion connected to the agitator.

3. The developing apparatus according to claim 2, wherein the weight of the connection portion is greater than the weight of the contact portion so that, when the contact portion does not contact the screw, the pivoting body pivots toward the connection portion due to the weight of the pivoting body.

4. The developing apparatus according to claim 1, wherein the pivoting body is pivotably coupled to a support portion provided above the collection path.

5. The developing apparatus according to claim 1, wherein the agitating body is formed of an elastic material.

6. The developing apparatus of claim 1, wherein said screw includes at least one contact member to intermittently contact and pivot said pivoting body.

7. The developing member of claim 6, wherein said pivoting member includes a contact portion for contacting said contact member of said screw, and said pivoting member includes a connection portion connected to said agitating body that pivots between the first position and the second position.

8. The developing member of claim 6, wherein said contact member is a transfer member on said screw.

9. The developing member of claim 1, wherein said agitating body is a flexible film having a first end coupled to said pivoting body member and a second free end.

10. The developing member of claim 9, wherein said agitating body has a length to extend from the waste toner accommodation chamber to the developing chamber.

11. The developing member of claim 9, wherein said agitating body reciprocates in response to the pivoting movement of the pivoting body.

12. An image forming apparatus having a developing apparatus for developing an image by supplying toner to an electrostatic latent image formed on a surface of a photosensitive medium by an exposing unit, the developing apparatus comprising:

a toner collection apparatus having a waste toner accommodation chamber that temporarily accommodates waste toner removed from a photosensitive medium, a screw installed in the waste toner accommodation chamber for transferring waste toner, a developing chamber for accommodating new toner to be supplied to the photosensitive medium, a collection path that connects the waste toner accommodation chamber to the developing chamber and through which the waste toner is delivered to the developing chamber; and an agitator for agitating waste toner to prevent the collection path from being clogged, the agitator comprising:

a pivoting body rotatably installed in the collection path and having one end in connection with the screw, the pivoting body being pivotally mounted to pivot about a fixed pivot point with respect to the collection path between a first position and a second position by rotation of the screw; and an agitating body having a first end connected to the pivoting body and a second free end arranged lengthwise in the collection path for agitating waste toner by interacting with the pivoting of the pivoting body.

13. The image forming apparatus according to claim 12, wherein the pivoting body comprises a contact portion contacting the screw to pivot the pivoting body between the first position and the second position and a connection portion connected to the agitator.

14. The image forming apparatus according to claim 13, wherein the weight of the connection portion is greater than the weight of the contact portion so that, when the contact portion does not contact the screw, the pivoting body pivots toward the connection portion due to the weight of the pivoting body.

15. The image forming apparatus of claim 13, wherein said screw includes a contact member to intermittently contact the contact portion of the pivoting body.

16. The image forming apparatus of claim 13, wherein said agitating body reciprocates in response to the pivoting movement of the pivoting body.

17. The image forming apparatus according to claim 12, wherein the pivoting body is pivotably connected to a support portion provided above the collection path.

18. The image forming apparatus according to claim 12, wherein the agitating body is formed of an elastic material.

19. A developing apparatus comprising:

a toner collection apparatus for collecting waste toner;

a developing chamber for accommodating new toner;

a collection path for delivering waste toner from the toner collection apparatus to the developing chamber;

a rotating screw located in the toner collection to transfer waste toner to the collection path;

a pivoting body installed in the collection path, the pivoting body having a contact arm for intermittently contacting the screw to pivot between a first position and a second position; and an agitating body connected to a connection arm member of the pivoting body, the agitating body agitating the waste toner.

20. The image forming apparatus according to claim 19, wherein the pivoting body comprises a contact portion contacting the screw to pivot the pivoting body between the first position and the second position and a connection portion connected to the agitator.

21. The image forming apparatus according to claim 20, wherein the weight of the connection portion is greater than the weight of the contact portion so that, when the contact portion does not contact the screw, the pivoting body pivots toward the connection portion due to the weight of the pivoting body.

22. The image forming apparatus according to claim 21, wherein the pivoting body is pivotally connected to a support portion provided above the collection path.

23. The image forming apparatus according to claim 22, wherein the agitating body is formed of an elastic material.

24. The developing apparatus of claim 20, wherein said connection portion has a length greater than a length of said contact portion.

25. The developing apparatus of claim 19, wherein said agitating body is a flexible film having a first end coupled to said pivoting body and a second free end.

26. The developing apparatus of claim 25, wherein said agitating body reciprocates in response to the pivoting movement of the pivoting body.

27. The developing apparatus of claim 19, wherein the pivoting body is pivotally mounted to a pivot about a fixed pivot point with respect to the collection path.

28. The developing apparatus of claim 19, wherein the contact arm moves in a direction opposite to a direction of movement of the connection arm when the pivoting body pivots.

* * * * *